US005437232A

United States Patent [19]

Borowski

[11] Patent Number: 5,437,232

[45] Date of Patent: Aug. 1, 1995

[54] BALLAST PLOW ASSEMBLY FOR A HOPPER-TYPE RAILROAD CAR

[75] Inventor: Norbert P. Borowski, Darlen, Ill.

[73] Assignee: Miner Enterprises, Inc., Geneva, Ill.

[21] Appl. No.: 169,246

[22] Filed: Dec. 20, 1993

[51] Int. Cl.[6] ..... B61F 19/00

[52] U.S. Cl. ..... 104/279; 104/2

[58] Field of Search ..... 104/2, 7.3, 279; 105/241.1, 247, 248; 37/104, 198, 203, 214, 215, 216, 217, 218

[56] References Cited

U.S. PATENT DOCUMENTS

| | | | |
|---|---|---|---|
| 2,756,520 | 7/1956 | Soule | 104/279 |
| 3,305,952 | 2/1967 | Dressler | 104/279 |
| 3,624,936 | 12/1971 | Yard | 104/279 |
| 4,170,942 | 10/1979 | Theurer | 104/7.3 |
| 4,227,324 | 10/1980 | Theurer | 104/279 |
| 4,235,029 | 11/1980 | Ulm | 104/279 |
| 4,454,822 | 6/1984 | Fischer | 105/250 |
| 5,052,132 | 10/1991 | Theurer et al. | 104/279 |
| 5,052,133 | 10/1991 | Mohr | 104/279 |
| 5,084,989 | 2/1992 | Theurer et al. | 104/279 |
| 5,090,483 | 2/1992 | Theurer et al. | 104/279 |
| 5,094,018 | 3/1992 | Theurer et al. | 37/104 |
| 5,097,608 | 3/1992 | Theurer et al. | 104/279 |
| 5,142,987 | 9/1992 | Freymuth et al. | 104/17.2 |
| 5,163,372 | 11/1992 | Galvan et al. | 105/240 |

*Primary Examiner*—Mark T. Le

[57] ABSTRACT

A ballast plow assembly adapted for connection to a frame of a hopper-type railroad car having a series of openings from which ballast is gravitationally discharged and which is supported for rolling movement over tracks or rails by a pair of wheeled undercarriages. The ballast plow assembly includes a ballast plow that is pivotally connected to the frame of the railroad car in proximate relation to the wheels of a respective undercarriage and has a free end which is automatically movable into engagement with an upper surface of the tracks under the influence of gravity for clearing the upper track surfaces from ballast discharged from the railroad car and for generally distributing ballast across the track bed. The forward end of the ballast plow extends across the upper track surfaces and generally normal to the tracks. A lift mechanism is provided in combination with the ballast plow for removing the track engaging end of the ballast plow from engagement with the track. A lock mechanism is also provided in combination with the ballast plow for releasably holding the ballast plow from engagement with the tracks.

16 Claims, 2 Drawing Sheets

BALLAST PLOW ASSEMBLY FOR A HOPPER-TYPE RAILROAD CAR

FIELD OF THE INVENTION

The present invention generally relates to hopper-type railroad cars and, more particularly, to a ballast plow assembly mounted on a hopper-type railroad car for clearing railroad tracks of ballast controllably discharged from openings in the car and for distributing ballast over a track bed.

BACKGROUND OF THE INVENTION

When new railroad track beds are created or when existing railroad track beds are being repaired, a train consist comprised of a multitude of hopper-type railroad cars filled with ballast are rolled over the tracks. The ballast from the cars is discharged onto the track bed through a series of openings provided on each railroad car. Typically, two or three longitudinally aligned openings are provided on each side of the car for discharging ballast onto the track bed outwardly of the tracks. Two or three other longitudinally aligned openings are provided on each side of the car for discharging ballast between the tracks. As is conventional, discharge gate assemblies are arranged in combination with each opening. By manipulation of a handle operatively connected to each gate assembly, the gate assembly is opened to control the discharge of ballast from the opening and onto the track bed.

A team comprised of several persons is typically associated with each railroad car in the train consist for discharging the ballast in their particular car onto the track bed. Each team for each railroad car is comprised of four to six different persons who individually control the operation of a particular gate assembly thereby controlling the discharge of ballast material from that particular car in the train consist. Additionally, another team member walks adjacent to the cars to communicate with the train engineer regarding several different aspects of train operation. As will be appreciated, the manual labor hours involved with independently controlling the discharge of ballast from each hopper car in the train consist has resulted in financial problems for the railroads. Accordingly, servicing of track beds which require maintenance is prolonged and development of new track beds is spumed.

Another problem associated with the discharge of ballast onto a track bed concerns maintaining the upper surfaces of the tracks clear of the ballast discharged from the railroad car. As will be appreciated, when the gate assemblies discharge ballast from the railroad car, a relatively large volume of ballast falls onto the track bed and the tracks over which the railcar moves are often buffed beneath the ballast. Because the ballast is comprised of hard particulate matter, such as stones and rocks, such materials can readily become lodged between an upper surface of the tracks and the wheels on an undercarriage of the railroad car. Such obstacles impede the ability of the railroad car to roll smoothly along the tracks and, thus, consequently add to the amount of energy required to pull the railroad car against the obstacle lodged beneath the wheels. Moreover, such obstacles have been known to cause the railcar to "ride up" over the obstacle thus causing a very real potential for derailment of the railcar.

For many years, a railroad tie was placed in front of the wheels of one of the undercarriages for wiping away the ballast from the top surface of the tracks and for leveling or distributing the ballast over the track bed. The railroad tie was pushed along by the rolling wheels of the railcar. As will be appreciated, proper positioning of the railroad tie was essential to achieve the desired result. The weight and general bulkiness of such ties requires two or even three persons to be added to each team to position the tie beneath the railcar and on top of the rails. Once the tie is positioned beneath the railroad car, at least one person is stationed on each side of each railroad car to assure that the railroad tie retains properly positioned on the track as the train consist moves along the track.

As will be appreciated, using a railroad tie to clear the upper surfaces of the track and generally distribute the ballast over the track bed adds further to the manual hours and thus the cost associated with creating a new railroad track bed or repairing an existing railroad track bed. That is, in addition to the four to six team members associated with each railroad car for controlling the discharge of ballast, two or three additional persons are added to each team associated with each railroad car for assuring that the upper surface of the tracks are cleared of ballast exhausted onto the track bed. Thus, the teams associated with each railroad car in the train consist could require seven plus persons for assuring proper discharge and leveling of the ballast for a new or repaired railroad track bed.

In addition to the manual hours and exorbitant costs, using a railroad tie for clearing the tracks and leveling the ballast has other drawbacks associated therewith. Because they ride against the rotating wheels of the undercarriage, the railroad ties wear out relatively rapidly and must be replaced. Moreover, track switches and other track level inconsistencies often prevent smooth sliding movement of the railroad tie thereover. When the railroad tie becomes snagged or otherwise prevented front smooth sliding movement over the top surfaces of the tracks, the tie wedges against the wheels of the undercarriage of the railroad car causing further resistance to car movement. At times, the wheels of the undercarriage tend to roll up the tie thus increasing the chances for railcar derailment.

Recently, Miner Enterprises, Inc. of Geneva, Ill., has introduced technology which greatly reduces the number of man hours required to control the gate assemblies of a hopper-type railroad car. U.S. Pat. No. 5,163,372 assigned to Miner Enterprises, Inc. discloses pneumatic drivers for operating the gate assemblies and thereby controlling the discharge of ballast material from the railway hopper cars. Thus, what previously required the efforts of four to six different individuals for each railroad car, is now accomplished by the press of a button. Thus, the problems of overly burdensome man hours associated with the discharge of ballast to the track bed has been substantially reduced. While greatly reducing the number of man hours required to control the gate assemblies of a hopper-type railroad car, the technology introduced by way of U.S. Pat. No. 5,163,372 did not solve the problem associated with removing ballast from the upper surface of the tracks over which the railroad car moves.

Thus, there is a need and desire for a ballast plow assembly for clearing the tracks or rails of ballast discharged from a railroad car and generally distributing the ballast about the track bed.

SUMMARY OF THE INVENTION

In view of the above, and in accordance with the present invention, there is provided a ballast plow assembly particularly adapted for connection to a hopper-type railroad car including a frame supported by two wheeled undercarriages for movement over a pair of railroad tracks. The railroad car includes discharge openings from which ballast material is discharged onto a track bed. The ballast plow assembly of the present invention preferably includes a ballast plow pivotally connected beneath the frame proximate to at least one of the undercarriages. The ballast plow has, in the direction of car movement, a forward end which automatically moves into engagement with an upper surface of the tracks under the influence of gravity for clearing the upper surface of the tracks of ballast discharged from the railroad car. The forward end of the ballast plow extends generally horizontally across and generally perpendicular to the tracks. A lift mechanism is provided for selectively removing the forward end of the ballast plow from engagement with the tracks. The present invention further includes a locking mechanism for releasably holding the ballast plow out of engagement with the tracks.

In a most preferred form of the invention, the ballast plow assembly further includes a support structure having a plurality of transversely spaced arms to which a rear end of the ballast plow is pivotally connected in a manner permitting generally vertical movement of the ballast plow between a track engaging position and a position where the ballast plow is removed from engagement with the tracks. The arms of the support structure are preferably arranged in laterally spaced relation to opposite sides of the respective under carriage. When the ballast plow is arranged in a track engaging position, the forward end of the ballast plow is lower than the rear end such that the ballast plow defines an attack angle between it and the upper surface of the tracks. In a most preferred form of the invention, the attack angle ranges between about 20 degrees and about 70 degrees relative to the upper surface of the tracks.

To promote movement of the ballast plow over track inconsistencies, the forward end of the ballast plow is provided with a track engaging section preferably having an arcuate configuration. In a most preferred form of the invention, the track engaging section of the ballast plow is comprised of at least two laterally aligned elongated members. Each member is centered on a respective track and is provided with an arcuate configuration on at least that portion of the member that engages the upper surface of the track.

The ballast plow further includes a planar section extending rearwardly from the track engaging section. The planar section distributes that portion of the ballast passing over the track engaging section over the track bed. In the preferred embodiment, the rear end of the planar section is pivotally connected to the underside of the railroad car frame.

The ballast plow of the present invention may further include a pair of laterally spaced deflectors. The deflectors are arranged in general alignment with the tracks for deflecting ballast passing over the upper surface of the planar section. More specifically, the deflectors direct ballast passing over that portion of the plow away from the upper surface of the tracks to prevent it from interfering with rolling movement of the under carriage over the upper surface of the tracks.

In one form of the invention, the lift mechanism includes a selectively operated mechanism for automatically removing the forward end of the ballast plow from engagement with the tracks. In this embodiment the lift mechanism includes a driver connected to the frame and to the ballast plow for removing the forward end of the plow from engagement with the tracks. A force transfer mechanism is disposed between the driver and the forward end of the plow for affecting movement of the plow in response to actuation of the driver. In another form of the invention, the lift mechanism comprises an elongated bar, one end of which is releasably received within an opening defined on the ballast plow for lifting the forward end of the ballast plow as by applying a pushing force to an opposite end of the elongated bar.

The purpose of the locking mechanism is to releasably hold the ballast plow from engagement with the tracks. In a most preferred form of the invention, the locking mechanism includes a spring biased latch which automatically engages with and holds the ballast plow from engagement with the tracks.

The ballast plow assembly of the present invention is adapted to be carried on the railroad hopper car and is selectively movable between a track engaging position and a removed position. In the track engaging position, the ballast plow serves to clear the upper surface of the tracks and distribute the ballast discharge from the ballast car over the track bed. Importantly, the ballast plow of the present invention substantially reduces the manual efforts required for clearing the upper surface of the tracks from ballast immediately in advance of the under carriage moving over the cleared surface of the tracks. When the ballast plow of the present invention is arranged in the track engaging position, the attack angle of the ballast plow maintains the track engaging section of the ballast plow in engagement with the upper surface of the tracks. Moreover, the ballast passing over the ballast plow maintains the forward track engaging section of the ballast plow in engagement with the upper surface of the tracks.

Notably, the track engaging section of the ballast plow is provided with an arcuate configuration on that portion which engages the track. Thus, when track inconsistencies, such as track switches and frogs are encountered, the ballast plow rides up over the inconsistencies without causing the wedging action associated with heretofore known railroad ties. After the ballast is exhausted from the railroad car, the ballast plow may be lifted to a removed position from the track. In its removed position, the locking mechanism engages and holds the ballast plow in the release position away front the track surface to facilitate transportation of the railroad car.

The ballast plow assembly of the present invention substantially eliminates at least two persons from the team associated with each railroad car in the train consist. Moreover, and if so desired, a ballast plow assembly may be arranged in association with each undercarriage on the railroad car. Thus, the ballast plow assembly is capable of clearing ballast discharged from that car notwithstanding the direction of car movement.

These and other features of the present invention will become readily apparent from the following detailed description, appended claims, in the attached drawings.

DETAILED DESCRIPTION OF THE DRAWINGS

DETAILED DESCRIPTION OF A PREFERRED EMBODIMENT

Figure 1:
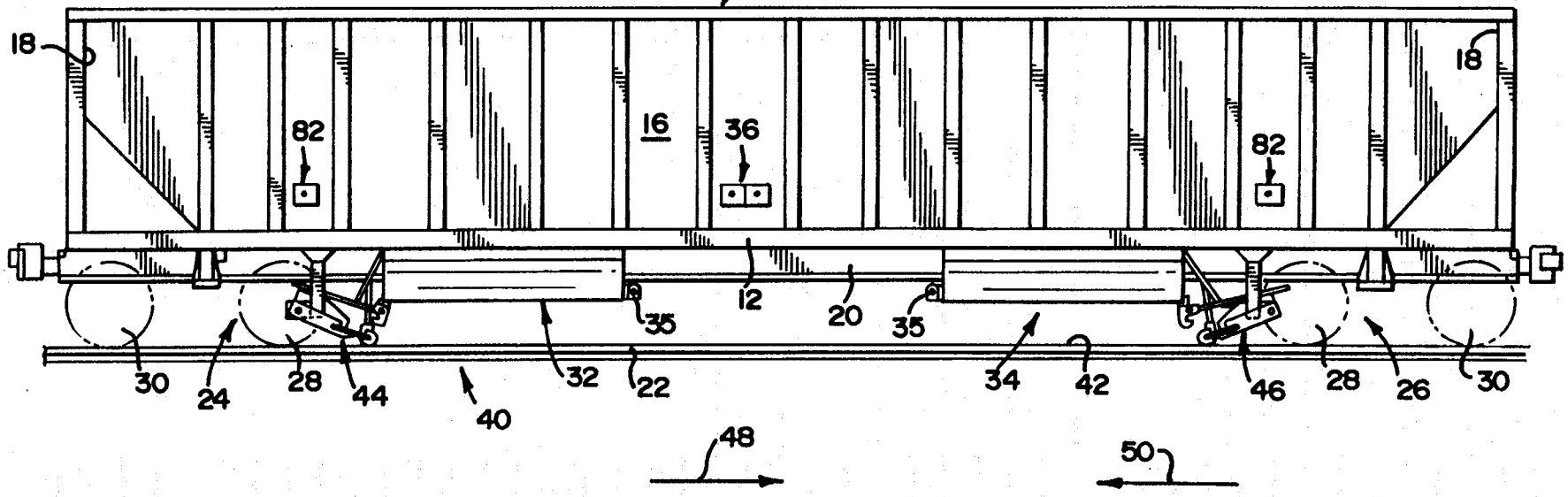
FIG. 1 is a side elevational view of a hopper-type railroad car having a ballast plow assembly according to the present invention mounted thereon.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals refer to like parts throughout the several views, a bulk material handling container such as a hopper-type railroad car is schematically illustrated in FIG. 1 and is designated generally by reference numeral. 10. Car 10 includes a mobile frame 12 to which is mounted a body 14 defined by a pair of laterally spaced upstruck sidewalls 16 only one of which is shown. Opposite ends of the sidewalls 16 are joined by tipstruck endwalls 18. As is conventional, body 10 further includes a bottom 20. The frame 12 and body 14 are supported for rolling movement over a pair of tracks or rails 22 in a well known manner by suitable undercarriages 24 and 26. Each undercarriage 24, 26 preferably includes a pair of inner wheels 28 and a pair of outer wheels 30.

To facilitate gravitational unloading of the ballast contained within the car body 14, the car bottom 20 is provided with a plurality of fore-and-aft spaced gate assemblies 32 and 34 arranged on each side of the body 14 for controllably regulating the discharge of ballast therefrom. The gate assemblies 32, 34 on each side of the body 14 are arranged within the distance separating the inner wheels 28 of the undercarriages 24 and 26. While only two gate assemblies are shown, it will be appreciated that more than two gate assemblies can be associated with the car without detracting from the spirit and scope of the present invention.

Preferably, the gate assemblies 32, 34 are of the type disclosed in U.S. Pat. No. 5,163,372 issued to Miner Enterprises, Inc. on Nov. 17, 1992; the full teachings of which are incorporated herein by reference. Suffice it to say, each gate assembly includes a first gate or door (not shown) for discharging ballast outwardly of a respective track or rail and a second gate or door (not shown) for discharging ballast inwardly of the respective track or rail. As disclosed in the above-mentioned patent, each gate assembly further includes powered drivers 35 for controlling operation of the gate and thereby the gravitational discharge of ballast from the hopper car as through operation of a switch 36 preferably mounted on the body 14 to provide easy access thereto or other suitable remote actuator.

According to the present invention, there is a provided a ballast plow assembly 40 connected to the frame 12 of the car 10. The purpose of the ballast plow assembly 40 is to clear the top surfaces 42 of the rails or tracks 22 of ballast discharged from the hopper car 10 and generally distribute the ballast over the track bed. As will be appreciated, the car 10 is moved along the track in either direction of movement. Thus, in a preferred form of the invention, the ballast plow assembly 40 includes first and second ballast plows 44 and 46 arranged approximate to the undercarriages 24 and 26, respectively. It will be understood that the first ballast plow 44 is operative to clear ballast from the top of the rails immediately in front of the undercarriage 24 as the plow moves in the direction of arrow 48. Whereas, the second ballast plow 46 is arranged approximate to the undercarriage 26 for clearing ballast from the top of the rails or tracks 22 as the car 10 moves in the direction of arrow 50.

Figure 2:
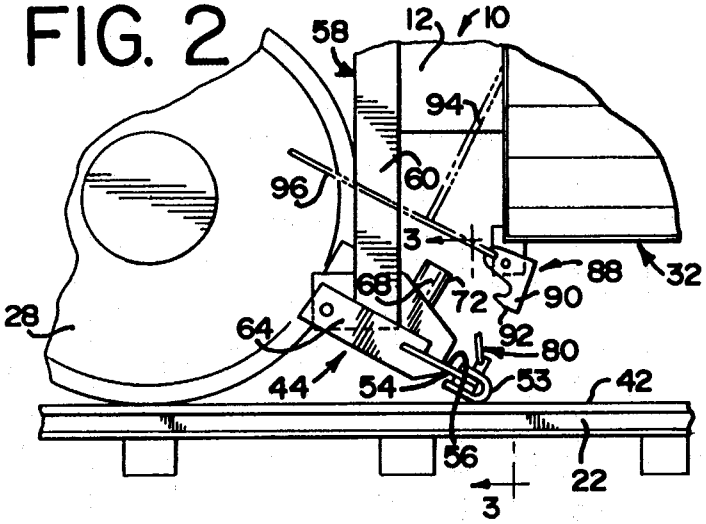
FIG. 2 is an enlarged fragmentary side elevational view of the ballast plow of the present invention.
Figure 3:
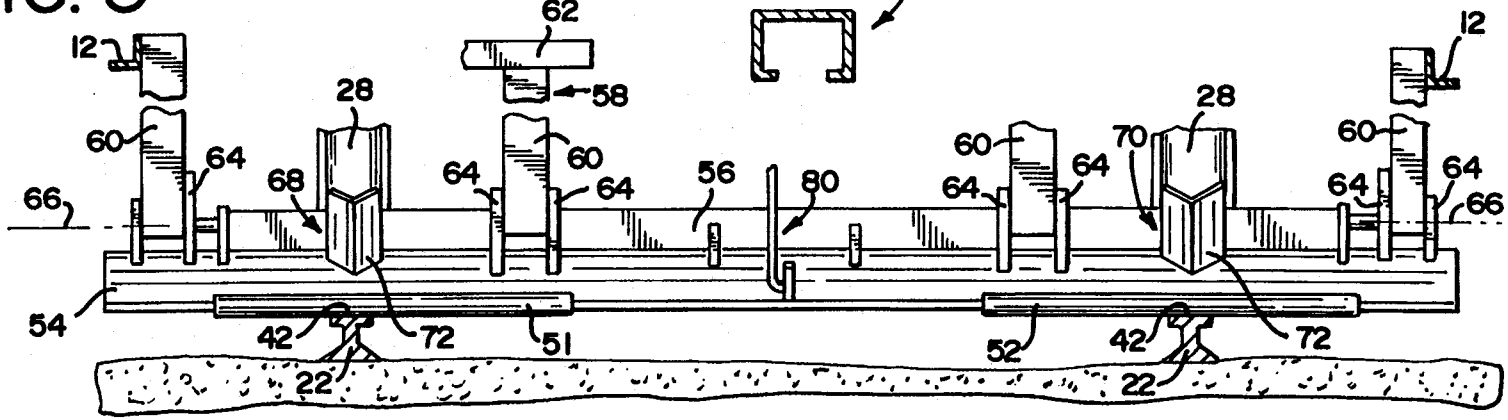
FIG. 3 is a sectional view taken along line 3—3 of FIG. 2.

The ballast plows 44 and 46 and associated structure are similar in construction and, therefore, only ballast plow 44 will need to be described in detailed. As shown in FIGS. 2 and 3, each ballast plow, in the direction of car movement, is pivotally connected to the frame 12 of the car 10. A free forward end of each ballast plow is moveable into engagement with the upper surface 42 of the tracks or rails 22 under the influence of gravity for clearing the upper surface of the tracks of ballast discharged from the hopper car. The forward end of each ballast plow extends generally horizontally across and generally perpendicular to the tracks.

Figure 4:
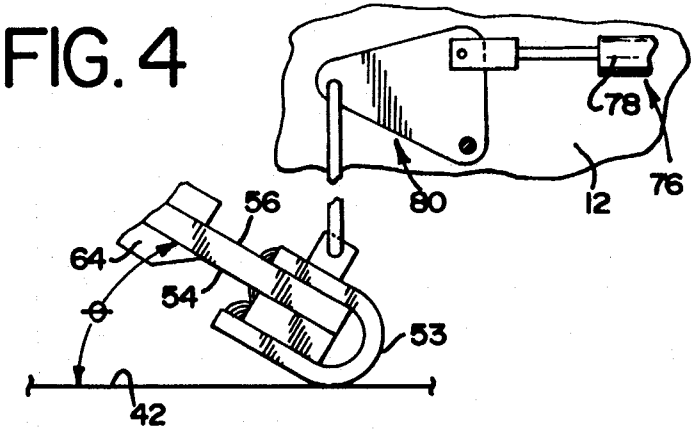
FIG. 4 is an enlarged side view of a track engaging section of the ballast plow with one form of lift mechanism associated therewith.

As shown in FIG. 3, the forward end or track engaging section of each ballast plow is comprised of at least two laterally aligned and laterally elongated members 51 and 52. Each member 51, 52 is generally centered on a respective track or rail 22. Moreover, each member 51, 52 comprising the track engaging section of the ballast plow as an arcuate edge 53 (FIG. 4) extending across its forward end. In a most preferred form of the invention, the arcuate edge 53 of the ballast plow has about a 1 inch radius of curvature. In the illustrated embodiment, the members 51, 52 are joined to each other by a generally planar section 54 extending rearwardly from the track engaging section of the plow blade and defining an upper surface 56 for the ballast plow. The rear end of the generally planar section 54 of each ballast plow is pivotally connected to the frame 12 of car 10.

A support structure 58 is provided to facilitate pivotal connection of each ballast plow to the frame 12 of the car 10. The support structure 58 includes a plurality of transversely or laterally spaced arms 60 that are connected to and depend from a generally horizontal support bar or beam 62 connected to the frame 12 of car 10. As shown in FIG. 3, the arms 60 are arranged in laterally spaced relation relative to the respective undercarriage. In a most preferred form of the invention, each ballast plow further includes a plurality of mounting arms 64 which extend from a rear edge of the generally planar section 54 and straddle the arms 60 of the support structure to facilitate pivotal connection of the ballast plow to the arms 60 of the support structure for movement about a generally horizontal axis 66.

As noted from FIG. 2, when the ballast plow is in a track engaging position as shown, the forward end or track engaging section thereof is elevationally lower than the rear end of the ballast plow. Very limited fore-and-aft spacing, however, is provided between the respective undercarriage and the adjacent side edge of the respective gate assembly from which ballast is discharged. Because the arms 60 of the support structure 58 are transversely spaced from the undercarriage, the arms 60 advantageously allow the mounting arms 64 of the ballast plow to be pivotally connected to the rearward side of the support structure 58. As such, the ballast plow defines an attack angle $\theta$ ranging between about 15° to about 75° relative to the upper surface 42 of the rails 22. Notably, the attack angle $\theta$ of the plow blade changes as a function of the mass of ballast remaining within the car 10. That is, a railroad car completely filled with ballast will ride lower to the rails than will an empty railroad car. Thus, the horizontal pivot axis 66 for the ballast plow will be arranged closer to the rails 22 when the car is full than when the railroad car is empty. As will be appreciated, the attack angle $\theta$ of the ballast plow is readily shiftable to accommodate changes in the mass of the car 10.

Each ballast plow further includes a pair of laterally spaced deflectors 68 and 70. The deflectors extend away from an upper surface 56 of the ballast plow. The deflectors 68, 70 are arranged in general alignment with the tracks 22. Each deflector 68, 70 has a V or convex shaped front wall 72 for deflecting ballast, passing over the upper surface 56 of the ballast plow, away from the upper surface 42 of the tracks 22.

Each ballast plow further includes a lift mechanism for removing the forward end of the ballast plow from engagement with the upper surface 42 of the tracks 22. In the embodiment of the invention illustrated in FIG. 4 the lift mechanism includes a powered driver 76 for removing the forward end of the ballast plow from engagement with the tracks. In a most preferred form of the invention, driver 76 comprises a pneumatically operated cylinder 78 mounted to the frame 12 and which is connected to the forward end of the ballast plow through a force transfer mechanism on linkage 80. When powered, the cylinder 78 serves to elevate the ballast plow from engagement with the tracks. Otherwise the cylinder 78 allows the track engaging section of the ballast plow to automatically move into engagement with the upper surface 42 of the tracks 22 under the influence of gravity. Control over powered operation of the driver may be controlled through a switch 82 (FIG. 1) or other form of remote actuator to facilitate proper positioning of the ballast plow.

Figure 6:
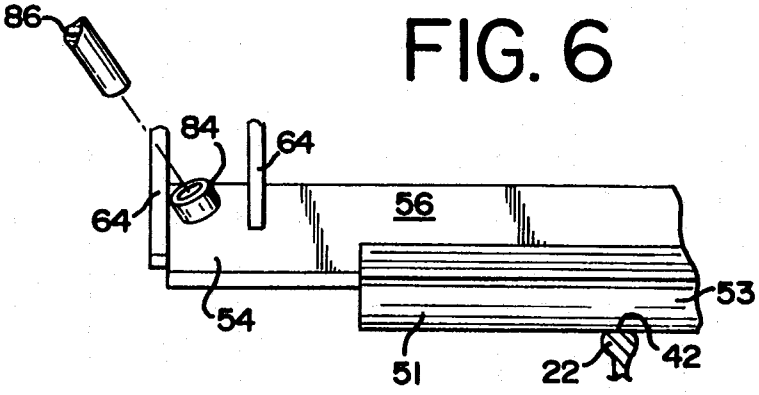
FIG. 6 is an elevational view of that illustrated in FIG. 5.
Figure 5:
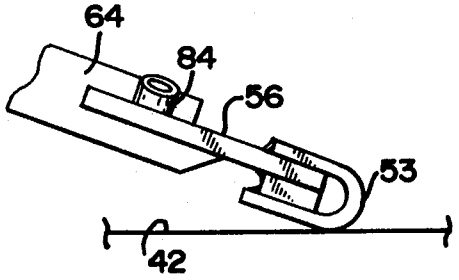
FIG. 5 is an enlarged side view of a track engaging section similar to FIG. 4 but with another form of lift mechanism associated with the ballast plow.

An alternative form of a ballast plow lift mechanism is schematically illustrated in FIGS. 5 and 6. In this alternative embodiment, a slanted aperture 84 is provided at each distal side portion of the planar section 54 which is accessible to the operator. The aperture 84 is slanted at an angle of about 45 degrees away from and relative to the upper surface 56 of section 54. Moreover, the aperture 84 is sized to releasably accommodate one end of an elongated bar 86 (FIG. 6) that is insertable into the aperture 84. Notably, the elevation of the outermost mounting arm 64 is sized as to not interfere with introduction of the bar 86 into the aperture 84. To affect a lifting action of the ballast plow, the operator presses against an opposite end of the bar 86 in a direction forcibly lifting the ballast plow from engagement with the upper surface 42 of the rails 22.

In a preferred form of the invention illustrated in FIG. 2, a locking mechanism 88 is arranged in operative association with each ballast plow for releasably holding the ballast plow in a position removed from engagement with the tracks 22. As shown, the locking mechanism 88 includes a latch 90 for automatically engaging the ballast plow when the ballast plow is removed from engagement with the tracks. As shown in FIG. 2, the latch 90 is mounted in the path of movement of the respective ballast plow. More particularly, the latch 90 is mounted for pivotal movement about a generally horizontal axis and includes a cam surface 92 which, upon engagement with the ballast plow, forcibly removes the latch 90 to allow passage of the ballast plow therepast.

In the illustrated embodiment, the latch 90 operates under the influence of a spring 94 that forcibly returns the latch 90 to a preset position whereby the latch 90 engages with and releasably holds the ballast plow in a position removed from engagement with the rails. A release bar 96 is engageable with and extends away from the latch 90. A free end of the bar 96 is positioned for ready accessibility from the side of the car 10. When the ballast plow is to be arranged in engagement with the top surface 42 of the rails 22, the release bar 96 is pressed downwardly thereby causing the latch 90 to pivot and move out of engagement with the ballast plow. Upon release of the locking mechanism 88, the ballast plow automatically and gravitationally moves into engagement with the top surface 42 of the rails 22.

During operation, ballast is controllably discharged from the car 10 through the gate assemblies 32 and 34. The ballast is preferably discharged from the railroad car through remote operation of the switch assembly 36 thereby reducing the number of man hours to control the gates during creation of a track bed or repair of a track bed. Notwithstanding the manner in which the ballast is discharged, some of the ballast gravitationally discharged from the railroad car will likely lie on the top surface 42 of the rails 22.

With the present invention, the ballast plow assembly will forcibly remove the ballast from the top surface 42 of the rails 22 and generally distribute the ballast over the track bed. Depending upon the direction of car movement, either ballast plow 44 or ballast plow 46 will be moved into engagement with the upper surface of the rails 22. Because the forward edge or track engaging section of each ballast plow is arranged proximate to the inner pair of wheels 28 of a respective undercarriage, the ballast plow effectively and efficiently removes ballast from the top surface of the rail immediately in advance of the wheels 28 passing thereover. Pivotally connecting the ballast plow to the frame 12 of the car allows the forward end or track engaging section of the ballast plow to remain in operative association with the top surface 42 of the rails 22 although the body 14 of the car 10 may elevationally move in response to the volume of ballast remaining within the car.

The attack angle of the ballast plow preferably allows ballast, which lies higher than the upper surface 42 of the rails 22, to pass over the upper surface 56 of the ballast plow. That portion of the ballast passing over the upper portion of the ballast plow tends to maintain the forward or track engaging sections 51 and 52 of the ballast plow in engagement with the rails 22. Moreover, that portion of the ballast passing over the upper surface 56 of the plow is deflected away from the rails by the deflectors 68 and 70 thus assuring that the upper surface 42 of the rails 22 will remain free of ballast thereby promoting free rolling movement of the wheels 28 thereover. Advantageously, the ballast plow will remain in engagement with the upper surface 42 of the rails without operator intervention. Thus, those team members or individuals associated with each rail car in the past for maintaining the railroad tie in association with the wheels to clear ballast off the rails are no longer required thereby further reducing the number of man hours associated with creation of a new track bed or repair of a track bed.

Notably, the arcuate edge configuration at the forward end or track engaging section of each ballast plow promotes movement of the ballast plow over track inconsistencies. Thus, when tracks switches or other track elevational inconsistencies are encountered by the ballast plow, the forward end of the ballast plow will "ride up" over the track inconsistency and allow uninterrupted movement of the car 10 thereover.

During car transport or after the ballast has been discharged from the car, the lift mechanism permits the forward end of the ballast plow to be removed from engagement with the upper surface 42 of the rails 22. In a most preferred form of the invention, the powered driver 76 will operate through the linkage 80 to elevate the track engaging section of the ballast plow frown engagement with the upper surface of the rails. Preferably, this is effected through remote actuation of the switch 82 thereby facilitating automatic movement of the plow blade from engagement with the rails. Alternatively, the elongated pry bar 86 may be inserted into the aperture 84 thereby permitting manually lifting the forward edge of the plow blade from engagement with the rails.

The locking mechanism 88 is arranged to releasably hold the ballast plow in a remote position out of engagement with the rails 22. The spring biased latch 90 releasably and positively holds the ballast plow out of engagement with the rails 22. Easy access to the release bar 96 promotes release of the locking mechanism 88 and thereby automatic movement of the ballast plow under the influence of gravity into engagement with the top surface 42 of the rails 22 whereat the ballast plow is positioned to effect clearing or wiping of the top surface of the rails in advance of the wheels passing thereover.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An apparatus including a ballast plow assembly connected to a hopper-type railroad car, said railroad car including a frame supported by two undercarriages for movement over the upper surfaces of a pair of railroad rails, said railroad car defining discharge openings from which ballast material is discharged, said ballast plow assembly comprising:

a ballast plow arranged proximate to one of said undercarriages for forcibly removing ballast discharged from said openings from the upper surfaces of the railroad rails and generally distributing ballast between the railroad rails, said ballast plow having, in the direction of car movement, a rear end pivotally connected to said frame, a free forward end configured to extend laterally across and gravitationally engage the upper surfaces of said railroad rails and an upper surface extending between said ends, wherein when said ballast plow is disposed to engage said rails, the forward end of the ballast plow is arranged lower than the rearward end to define an attack angle relative to the upper surfaces of the railroad rails such that ballast discharged forwardly and arranged higher than the upper surfaces of the railroad rails will pass over the upper surface of the plow thereby urging the forward end of the ballast plow into contact with the upper surfaces of the railroad rails;

a lift mechanism for removing the forward end of the ballast plow from engagement with the railroad rails; and a locking mechanism for releasably holding the ballast plow out of engagement with the railroad rails.

2. The apparatus according to claim 1 further including a support structure for pivotally connecting said ballast plow to the frame of the railroad car, said support structure including a plurality of transversely spaced arms including at least two arms that are arranged in outwardly spaced relation frown a respective undercarriage and to which the rear end of the ballast plow is pivotally connected.

3. The apparatus according to claim I wherein that portion of the forward end of said ballast plow that engages the upper surfaces of the rails has an arcuate configuration to facilitate said ballast plow moving over the rails.

4. The apparatus according to claim 1 wherein said ballast plow comprises a railroad rails engaging section having an accurate edge portion extending along its forward end and a laterally elongated generally planar section extending rearwardly from the railroad rail engaging section and pivotally connected to the frame of the railroad car.

5. The apparatus according to claim 4 wherein said ballast plow further includes a pair of laterally spaced deflectors arranged in general alignment with the railroad rails for deflecting ballast passing over an upper surface of the ballast plow away from the railroad rails.

6. The apparatus according to claim 1 wherein said attack angle ranges between about 20° and about 70° relative to the upper surface of the railroad rail.

7. The apparatus according to claim 1 wherein said lift mechanism includes a driver mounted on the frame for removing the forward end of the ballast plow from engagement with the railroad rails.

8. An apparatus including a ballast plow assembly connected to a hopper-type railroad car, said hopper-type railroad car including an elongated frame supported for movement by two undercarriages for rolling movement over a pair of railroad rails having upper surfaces, said car having automatically operated gates arranged thereon for controlling discharge of ballast material from openings defined in said frame, said ballast plow assembly comprising:

a ballast plow arranged beneath said frame proximate to one of said undercarriages, said ballast plow being pivotally connected to an underside of the frame and having, in the direction of railroad car movement, a forward end which automatically moves into engagement with the upper surfaces of the railroad rails under the influence of gravity for clearing the upper surfaces of the railroad rails of ballast discharged from said openings, said forward end of the ballast plow extending generally horizontally across and generally perpendicular to said railroad rails, and wherein when said ballast plow engages said railroad rails, an upper surface of the ballast plow, extending rearwardly from the forward end, angles upwardly away from the railroad rails such that the discharged ballast arranged forward of the ballast plow and higher than the upper surfaces of the railroad rails will pass over the ballast plow thereby maintaining the forward end in contact with the railroad rails; and a mechanism for positioning the forward end of the ballast plow relative to the upper surfaces of the railroad rails.

9. The apparatus according to claim 8 further includes a support structure including a plurality of laterally spaced arms depending from the frame of the railway car and to which a rear end of the ballast plow is pivotally connected to permit generally vertical movement of the ballast plow between a railroad rail engaging position and the position whereat the ballast plow is removed from engagement with the railroad rail.

10. The apparatus according to claim 9 wherein the outermost arms of said support structure are laterally arranged to opposite sides of the respective undercarriage, and wherein the rear end of the ballast plow is pivotally connected on a rearward side of the arms such that the ballast plow defines an included angle between it and the upper surfaces of the railroad rails ranging between about 15° and 75°.

11. The apparatus according to claim 8 wherein said ballast plow comprises a railroad rail engaging section having an arcuate configuration to promote sliding movement of the forward end of the ballast plow over the upper surface of the railroad rail and a planar section extending from the railroad track engaging section for generally distributing ballast passing thereover.

12. The apparatus according to claim 8 wherein said railroad rail engaging section of the ballast plow is comprised of at least two laterally aligned and laterally elongated members, which each member being generally centered on a respective railroad rail.

13. The apparatus according to claim 10 wherein said ballast plow further includes mounting arms which extend frown a rear edge of the ballast plow and straddle the arms of the support structure to facilitate pivotal connection of the ballast plow to the arms for movement about a generally horizontal axis.

14. The apparatus according to claim 8 wherein said ballast plow further comprises laterally spaced deflectors for deflecting ballast passing over the ballast plow away from the upper surfaces of the rails.

15. The apparatus according to claim 8 wherein said positioning mechanism includes a driver connected to the frame and to the ballast plow for removing the forward end of the plow from engagement with the rails.

16. The apparatus according to claim 8 further including a lock mechanism for engaging and releasably holding the ballast plow in a position removed from engagement with said rails.

* * * * *